US005473311A

United States Patent [19]

Hoseit

[11] Patent Number: 5,473,311

[45] Date of Patent: Dec. 5, 1995

[54] METHOD AND APPARATUS TO DISTINGUISH HUMAN INTRUDER AND ANIMAL INTRUDER

[75] Inventor: Paul Hoseit, El Dorado Hills, Calif.

[73] Assignee: C&K Systems, Inc., Folsom, Calif.

[21] Appl. No.: 307,915

[22] Filed: Sep. 16, 1994

[51] Int. Cl.[6] ..... G08B 19/00

[52] U.S. Cl. ..... 340/573; 340/522; 340/541; 340/554; 340/552; 340/565; 340/550; 342/27; 342/28

[58] Field of Search ..... 340/573, 522, 340/521, 541, 550, 554, 552, 565; 342/27, 28

[56] References Cited

U.S. PATENT DOCUMENTS

| | | | |
|---|---|---|---|
| Re. 33,824 | 2/1992 | Johnson | 340/522 |
| 4,401,976 | 8/1983 | Stadelmayr | 340/522 |
| 4,546,344 | 10/1985 | Guscott et al. | 340/522 |
| 4,625,199 | 11/1986 | Pantus | 340/522 |
| 5,109,216 | 4/1992 | Yarbrough et al. | 340/544 |
| 5,226,416 | 7/1993 | Bethune | 340/573 |
| 5,266,807 | 11/1993 | Neiger | 340/573 |

OTHER PUBLICATIONS

Napco C-100ST Series, Adaptive Combination Microwave/PIR Sensor—Preliminary Data Sheet.

*Primary Examiner*—John K. Peng
*Assistant Examiner*—Albert K. Wong
*Attorney, Agent, or Firm*—Limbach & Limbach; Ronald L. Yin

[57] ABSTRACT

An intrusion detection device of the dual sensing type has a PIR sensor to generate a PIR signal. The device also has a microwave sensor for generating a microwave amplitude signal. The microwave amplitude signal is filtered to generate a microwave high frequency signal which is the high frequency portion of the microwave amplitude signal. These three signals: PIR signal, microwave amplitude signal, and microwave high frequency signals are amplified and are digitized and are processed to generate an event signal. The event signal is compared to an event threshold signal and an alarm is generated in the event the event signal exceeds the event threshold signal. The event threshold signal represents the threshold to distinguish between a human intruder and an animal intruder.

19 Claims, 11 Drawing Sheets

| | |
|---|---|
| FIG. 1A | FIG. 1D |
| FIG. 1B | FIG. 1E |
| FIG. 1C | FIG. 1F |

KEY TO FIG. 1

METHOD AND APPARATUS TO DISTINGUISH HUMAN INTRUDER AND ANIMAL INTRUDER

This application is submitted with a microfiche appendix, Exhibit A, and containing copyrighted material, Copyright 1994, C & K Systems, Inc. The appendix consists of one (1) microfiche with thirty-six (36) frames. The copyright owner has no objection to the facsimile reproduction by anyone of the patent document or the patent disclosure, as it appears in the Patent and Trademark Office patent file or records, but otherwise reserves all copyright rights whatsoever in the appendices.

1. Technical Field of the Invention

The present invention relates to an intrusion detection system and more particularly, to a detection system of the dual sensing type, wherein a PIR signal, a microwave amplitude signal and a microwave high frequency signal are generated and are processed to distinguish between a human intruder and an animal intruder.

2. Background of the Invention

Intrusion detection systems, and more particularly, systems of the dual sensing type, are well known in the art. In an intrusion detection system of the dual sensing type, the two detectors must be positioned to detect intrusion in substantially the same volume of space. Further, the two detectors must both be operational. In the event one of the detectors is not operational or the two detectors are both operational but are not directed towards the same volume of space, then the entire detection system could fail in that it would fail to detect an intruder in the intended volume of space to be protected.

One prior art reference, U.S. Pat. No. Re 33,824, which is incorporated herein by reference, teaches the generation of a fault signal if a dual sensing intrusion detection system has failed.

Although dual sensing intrusion detection systems are more immune to false alarms than single technology devices, the "catch" may still be too large, resulting in false alarms.

In U.S. Pat. No. 5,109,216, the gain of an amplifier in the electronic circuitry to process the detection signal from one channel is adjustable. In addition, the threshold of one channel can be adjusted based upon the detection from another channel. The disadvantage of such a system is that since adjustment of the gain of an amplifier and the comparison of the threshold signal occur in the analog environment, the electronics can be costly. In addition, the different types of conditions under which the detector operates and which can be adjusted, is limited.

A Napco C-100 ST combination microwave/PIR sensing device, manufactured by Napco Security Systems, Inc. has been advertised as having "adaptive" threshold.

A DT6 microwave/PIR sensing device, manufactured by C & K Systems, Inc. uses a thermistor to detect the ambient temperature and to adjust statically a digital PIR threshold signal.

Furthermore, active anti-masking is known from the prior art. In addition, see, U.S. Pat. No. 4,546,344.

Finally U.S. patent application Ser. No. 08/011,647, filed on Jan. 28, 1993, and assigned to the present assignee, discloses a method and apparatus for processing signals from a dual sensing detection device in which to further reduce the incidence of false alarm, signals received by the dual sensing detection device must be processed in a particular sequence. The subject matter of that application is incorporated herein by reference.

While the foregoing prior art describes various methods and apparatuses relating to dual detection devices of the microwave and PIR type, thus far, the prior art has not taught specific methods and apparatuses to distinguish the type of intruder, such as a human intruder from an animal intruder.

SUMMARY OF THE INVENTION

Therefore, in accordance with the present invention, an intrusion detection device of the dual sensing type detects an intruder in a volume of space. The device has a microwave sensor for generating a first signal in response to the detection of the intruder in the volume of space. A first amplifier amplifies the first signal and generates a first amplified signal in response thereto. A high frequency filter receives the first signal and generates a second signal in response thereto. The second signal is a high frequency microwave signal and is the high frequency portion of the first signal. A second amplifier amplifies the second signal and generates a second amplifier signal in response thereto. A PIR sensor generates a third signal in response to the detection of the intruder of a volume of space. A third amplifier amplifies the third signal and generates a third amplified signal in response thereto. The first, second and third amplified signals are digitized to produce first, second and third digitized signals, respectively. A processor receives and processes the first, second and third digitized signal to generate an event signal. The event signal is compared to an event threshold signal and an alarm signal is generated in the event the event signal exceeds the event threshold signal. The event threshold signal distinguishes between the human intruder and the animal intruder.

DETAILED DESCRIPTION OF THE DRAWINGS

Figure 1A:
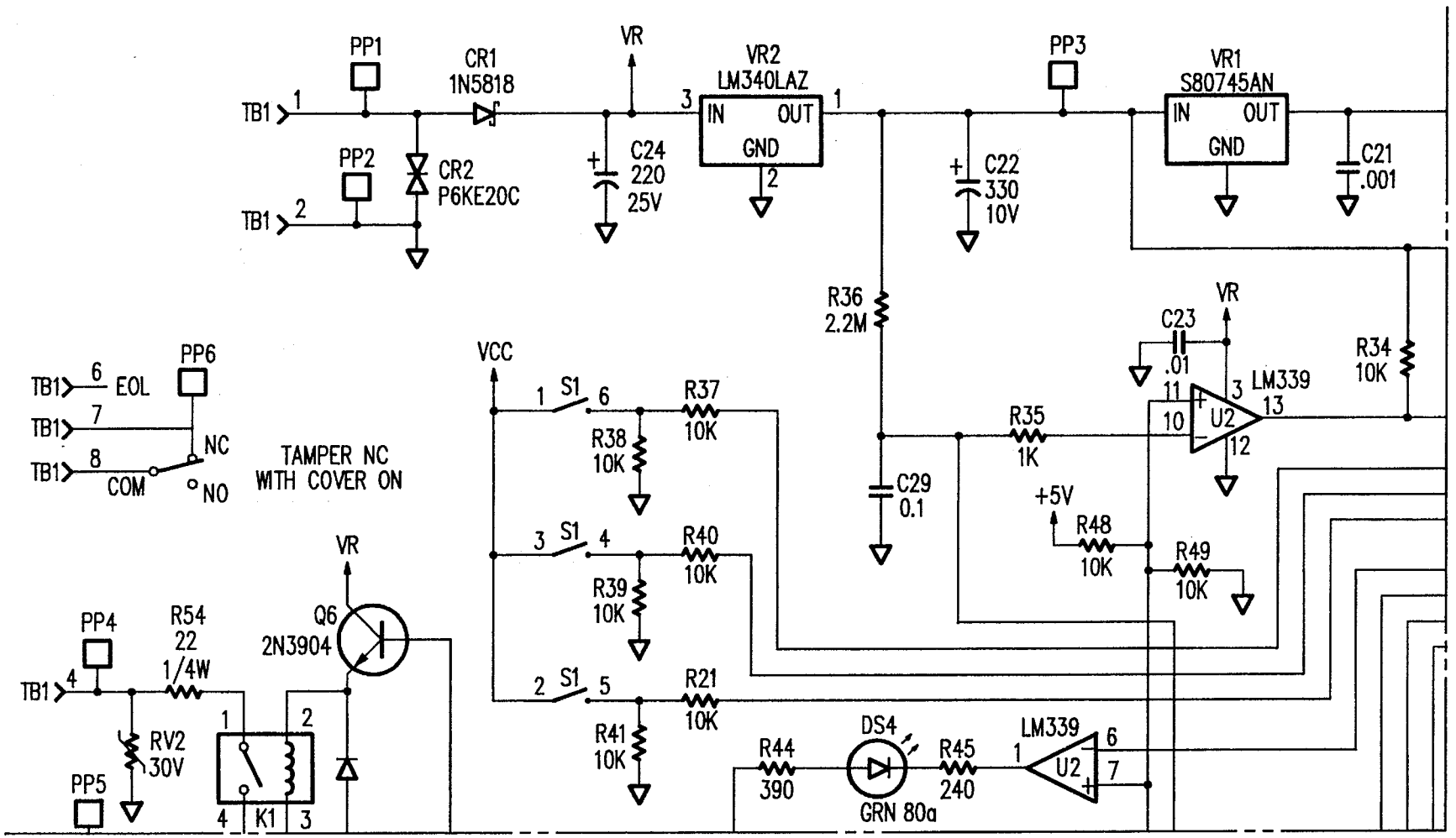
FIG. 1 (comprising FIGS. 1A and 1B, in total) is a schematic circuit diagram of the intrusion detection system of the present invention.
Figure 1B:
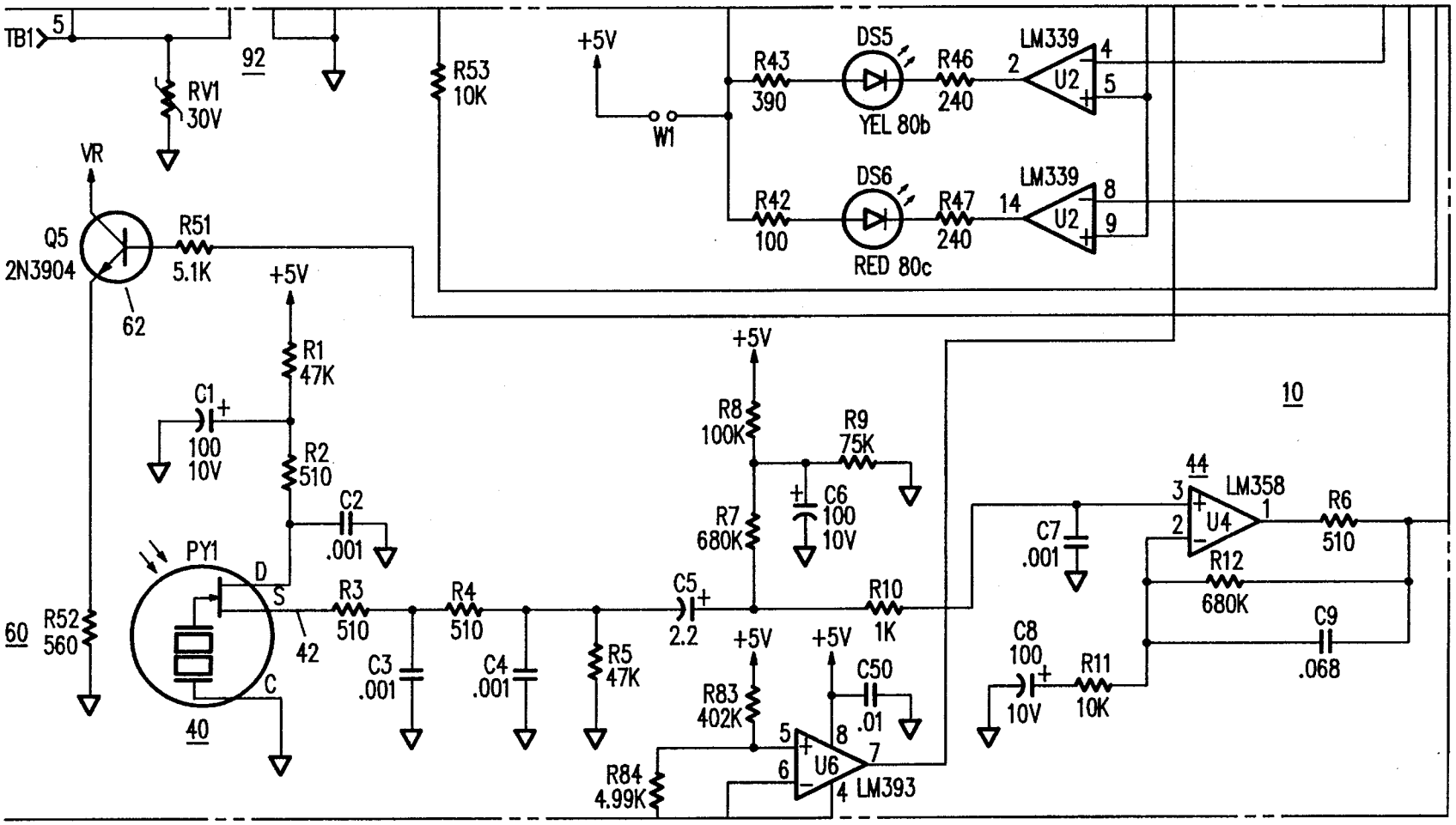
Figure 1C:
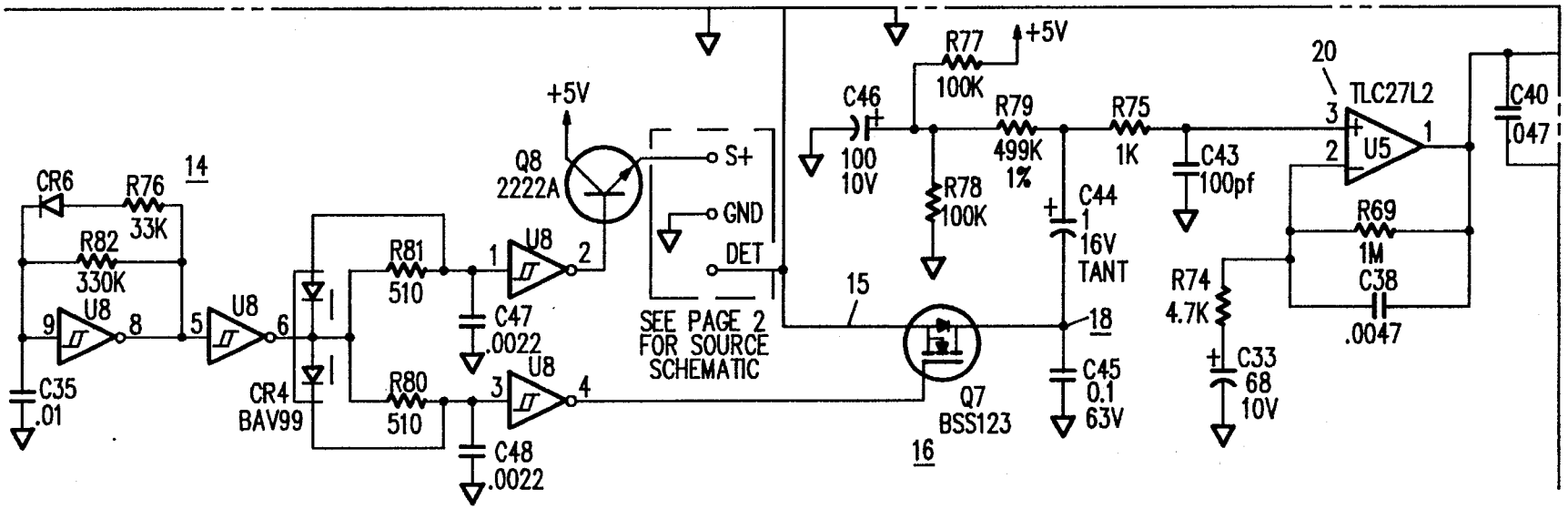
Figure 1D:
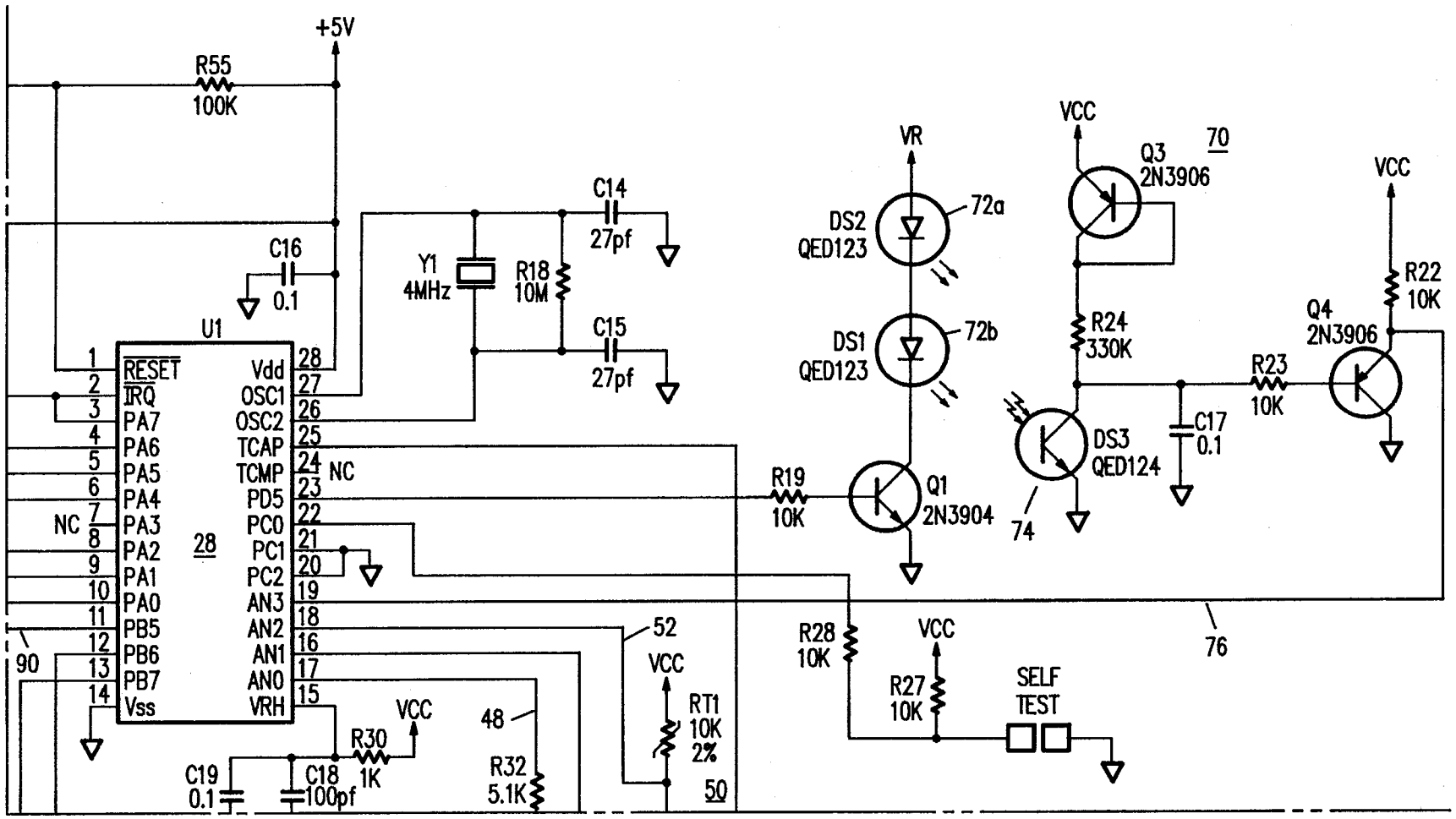
Figure 1E:
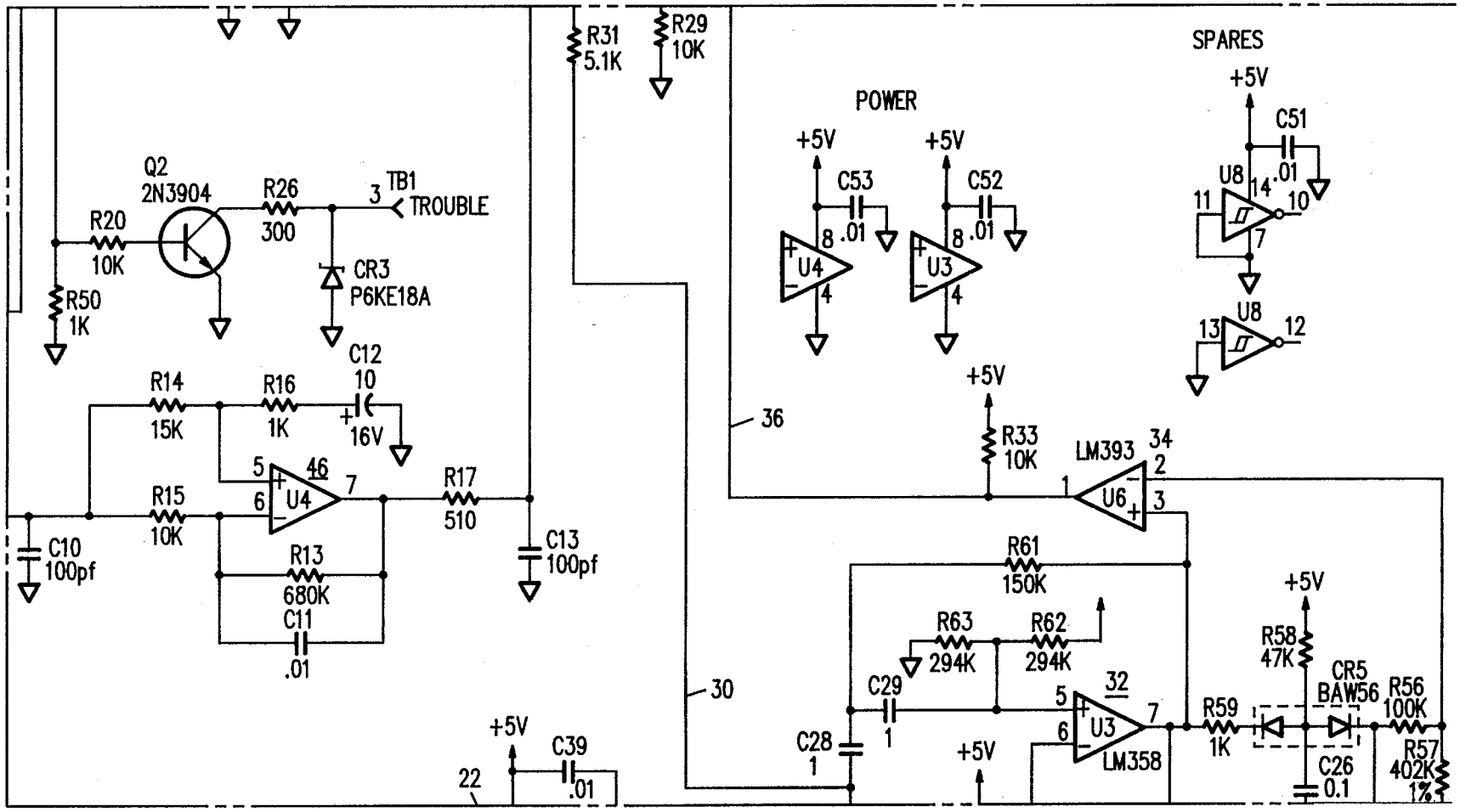
Figure 1F:
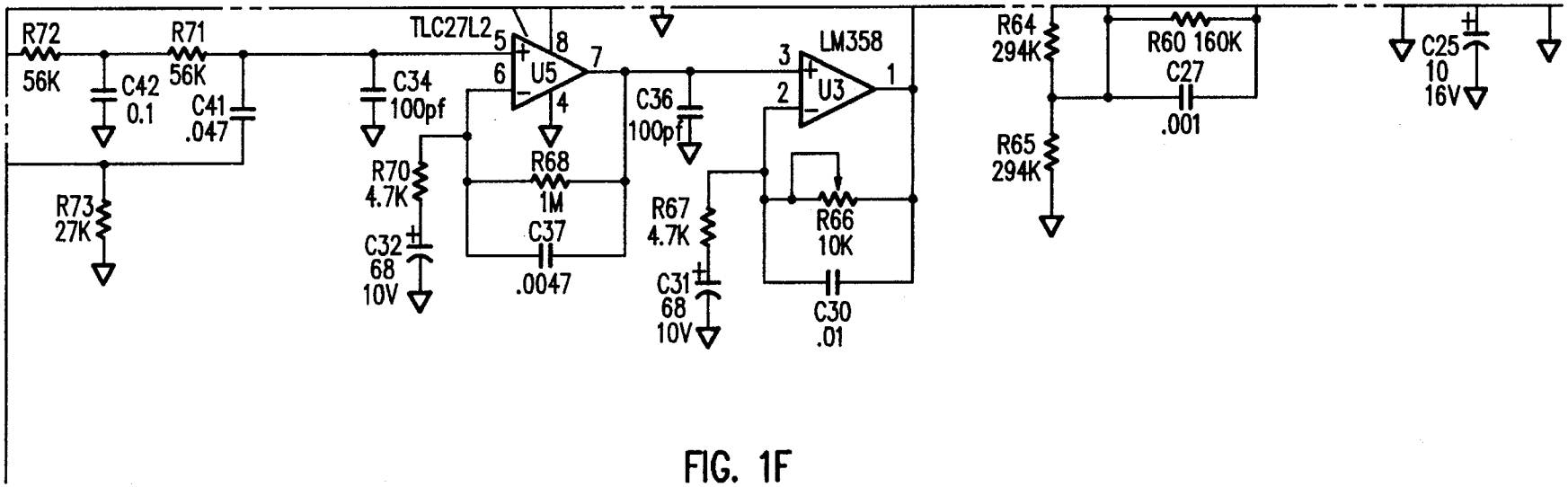
Figure 5:
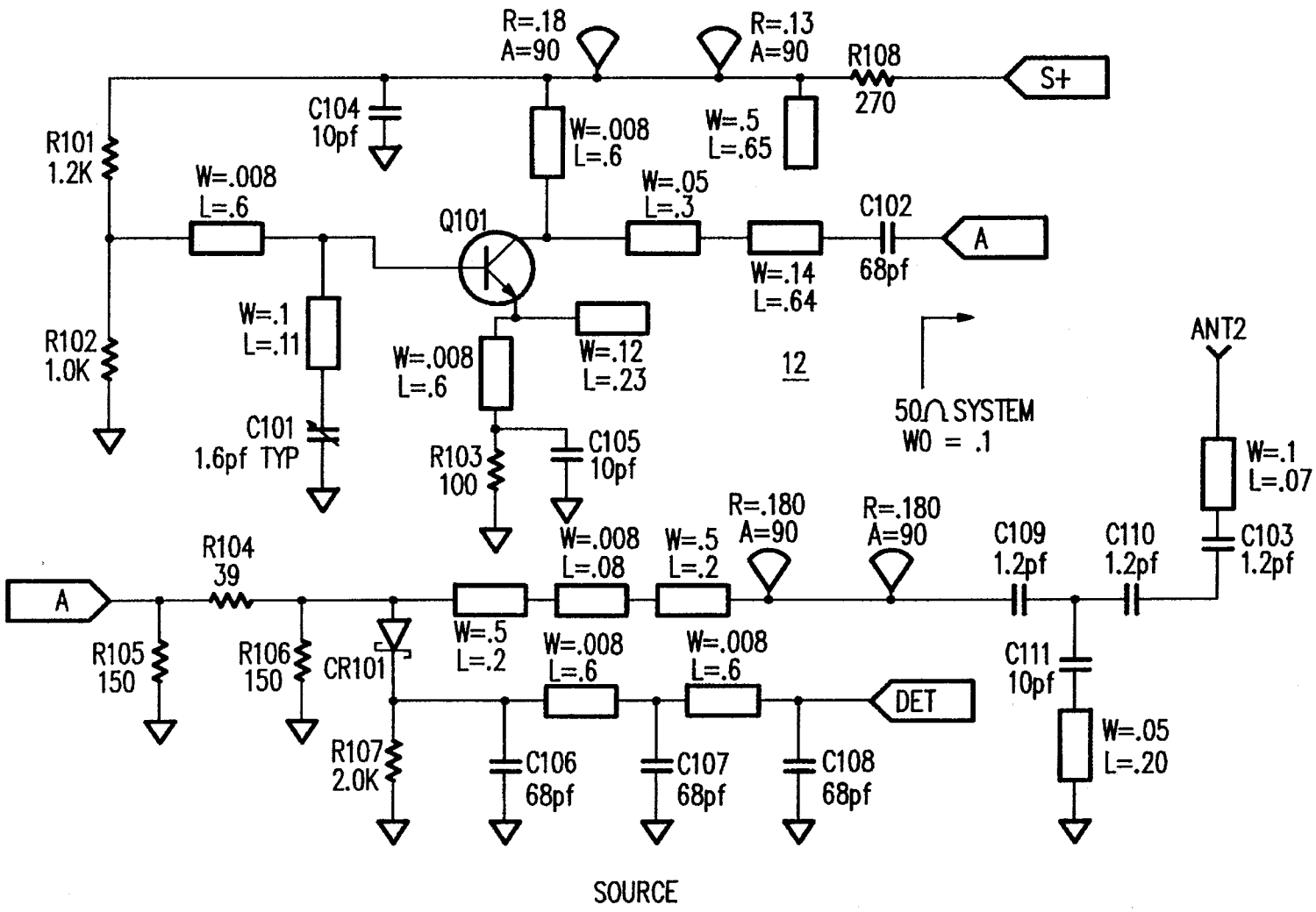
FIG. 5 is a circuit diagram of a portion of the intrusion detection system shown in FIGS. 1A and 1B for generating and receiving microwave radiation.

Referring to FIGS. 1A and 1B, there is shown a detailed circuit diagram of an intrusion detection system 10 of the present invention. The intrusion detection system 10 comprises a microwave transceiver 12, shown in FIG. 5. The microwave transceiver 12 operates in the S-band and radiates S-band microwave radiation into a volume of space and receives doppler shifted S-band microwave radiation from that volume of space. As is well known, in the event a moving intruder is detected in that volume of space, the received S-band radiation would contain doppler shifted signals. The microwave transceiver 12 is pulsed by an oscillator pulse 14 generating the requisite microwave signals. The received signal 15 from the transceiver 12 is a doppler shifted signal and is supplied to a transistor 16 labelled Q7BSS123 to which the signal from the oscillator pulse generator 14 is also sent. In the event no intruder is present, then the received signal 15 would match the signal from the oscillator pulse generator 14 and no signal would be generated at the node 18. However, if the received signal 15 contains a doppler shifted signal, then the output of the node 18 is simply of a doppler shifted signal. This doppler shifted signal is then supplied to an amplifier chain consisting of a first amplifier 20 and a second amplifier 22 each being a part TLC27L2 having a substantially constant gain. The output of the amplifier 22 is an amplified microwave signal 30 which is supplied to pin 16 of a microcontroller MC68HC05P9DW, available from Motorola, In addition, the first amplified signal 30 is passed through a high pass filter 32 which permits only the high frequency components of the first amplified microwave signal 30 to be passed therethrough. The output of the high pass filter 32 is a high frequency doppler signal which is sent to comparator 34. High frequency signals of sufficient amplitude cause the comparator 34 to switch. Signal 36 is therefore a series of pulses or a pulse train from which the period or frequency is calculated by the microcontroller 28.

The system 10 also comprises a second sensor 40 which in the preferred embodiment is a PIR detector 40. The PIR detector 40 generates a PIR signal 42 which is in response to the detection of infrared radiation generated by an intruder in a volume of space, the approximate same volume of space to which the microwave transceiver 12 is directed to detect. As is well known in the art, the PIR detector 40 through a segmented mirror or lens, detects the presence of an intruder crossing into or out of a plurality of spaced apart finger-like regions. As the intruder passes into or out of a region, the magnitude of the PIR radiation from that region changes due to the presence of the infrared radiation radiating from the intruder. This would cause the generation of the PIR signal 42. The PIR signal 42 is supplied to a second amplifier chain consisting of amplifiers 44 and 46, each of which also has a substantially constant gain. The amplified PIR signal 48 is then supplied to pin 17 of the microcontroller 28.

The system 10 also comprises a thermistor 50 which is positioned substantially adjacent to the PIR detector 40. The thermistor 50 measures the temperature of the ambient air surrounding the system 10. The thermistor generates a thermistor signal 52 which is supplied to pin 18 of the microcontroller 28. The thermistor signal 52 can be, but need not be, amplified by an amplifier having a substantially constant gain.

In addition, the system 10 has a resistor 60 positioned substantially adjacent to the PIR detector 40. The resistor 60 is electrically connected through a transistor 62 to pin 13 of the microcontroller 28 and is directly under the control of the microcontroller 28. When the microcontroller 28 sends a signal to the base of the transistor 62, this would turn on the transistor 62 causing current to flow through the resistor 60 causing it to radiate infrared radiation, which can be detected by the PIR detector 40. This would be a part of a self-test feature, which will be explained in greater detail hereinafter.

The system 10 also comprises an anti-masking circuit 70. The anti-masking circuit 70 comprises two LEDs **72*a* and 72*b* each of which generates near infrared radiation. In addition, the anti-masking circuit 70 comprises a photo transistor 74 for detecting the near infrared radiation generated by the LED 72*a* and 72*b*, directed outward from the system 10 and reflected from an intruder or other object into the photo transistor 74. The power of the infrared LEDs 72*a* and 72*b* is regulated such that any object placed within two feet of the system 10 would reflect the infrared radiation and would be detected by the photo transistor 74. The infrared radiation LEDs 72*a* and 72*b* are connected to pin 23 of the microcontroller 28. An anti-masking signal 76 which is the output of the photo transistor 74 is supplied to pin 19 of the microcontroller 20*a***.

Finally, the system 10 comprises a plurality of LEDs **80*a*, 80*b* and 80*c* which are green, yellow and red LEDs, respectively. These LEDs 80 are under the control of the microprocessor 28 through control pins 8, 9, and 10 respectively. In the normal alarm state, green LED 80*a* signifies a detection by the PIR sensor, or PIR event. Yellow LED 80*b* signifies a detection by the microwave sensor, or a microwave event. Red LED 80*c*** signifies an alarm condition. In the self test mode, the LEDs preset patterns are designed to show what is being tested.

In the event an intruder is detected in the volume of space, the microcontroller 28 would generate an alarm signal 90 supplied from pin 11 to an alarm relay 92.

The microcontroller 28 has, as an integral part thereof, a microprocessor, memory (ROM), Analog-to-Digital (A/D) converter, and Pulse Period Capture, used for high frequency period measurement. Thus, the PIR signals 48, microwave signal 30, and anti-masking signal 76 are all digitized by the A/D converter portion of the microcontroller 28 to generate a digitized PIR signal, a digitized microwave signal, and a digitized anti-masking signal, respectively. The high frequency microwave signal 36 is digitized by the comparator 34, and the Pulse Period Capture input of the microcontroller 28.

Figure 2:
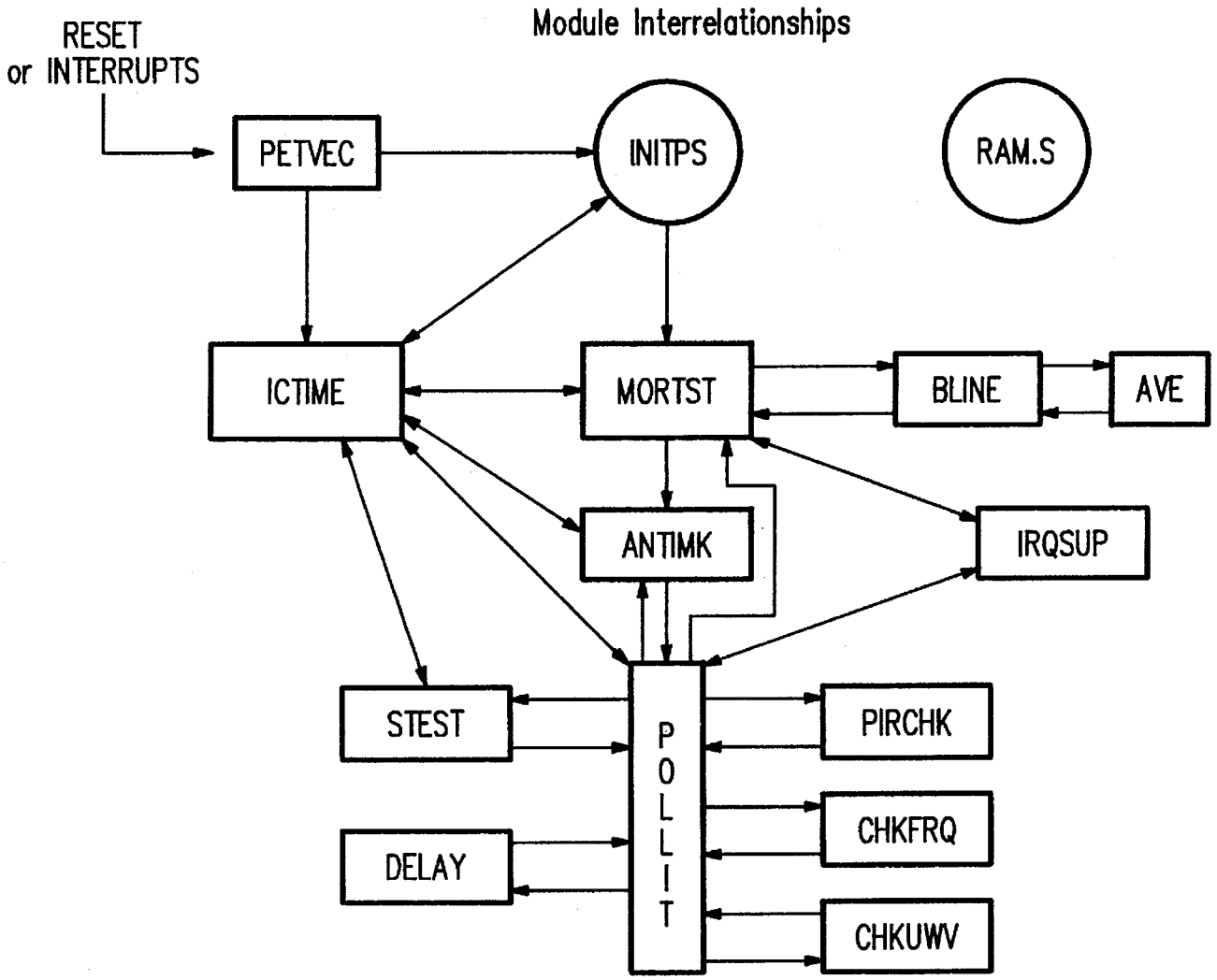
FIG. 2 is a block level diagram of the relationship between the different software modules as set forth in the appendix.

The microprocessor portion of the microcontroller 28 operates a software program whose listing is disclosed on Appendix Exhibit A. The listing comprises a plurality of software modules. The relationship between each of the modules is shown in FIG. 2. One of the functions of the software is to take each of the digitized PIR signal, digitized microwave signal, and digitized high frequency microwave signal and compare them to a PIR threshold signal, a microwave amplitude threshold signal, and a microwave frequency threshold signal, respectively. The signals generated as a result of the comparison are further processed by the software to adjust the threshold signals (PIR, microwave amplitude, and microwave frequency), and to process the signal causing event to distinguish the intruder between a human intruder and an animal intruder, all as described in detail hereinafter.

Figure 3:
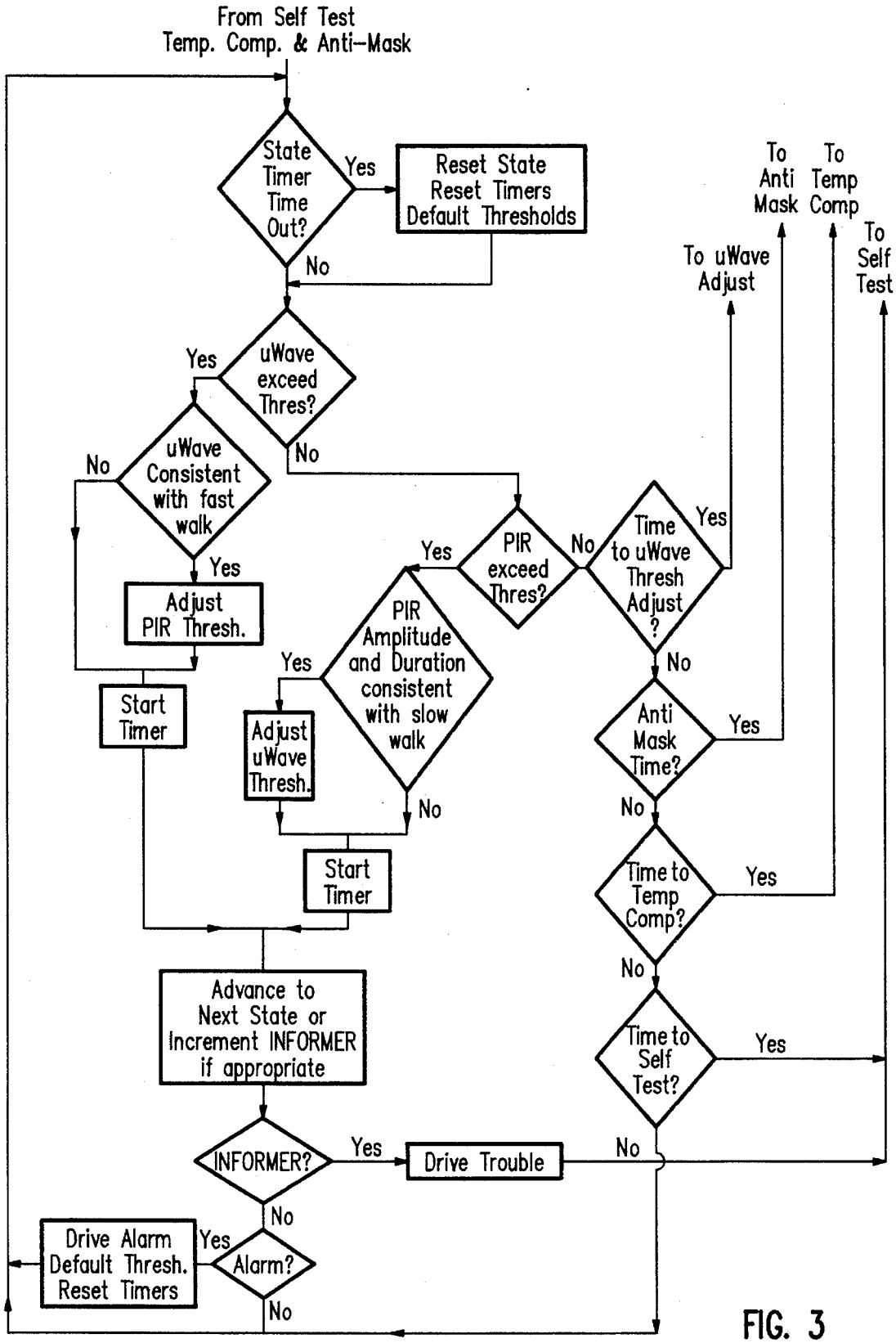
FIG. 3 is a flow chart diagram of an embodiment of one signal processing method used in the apparatus of the present invention shown in FIG. 1.

Referring to FIG. 3, there is shown a flow chart of the operation of one aspect of the method of operation of the apparatus 10. The software that performs the steps shown in FIG. 3 permits the system 10 to adjust both dynamically and statically, the threshold signals. In addition, the software performs a number of self-tests to determine the operability of the system 10. These are described as follows:

I. Self Test for Tampering.

If the microwave channel detects activity, i.e. the microwave signal 30 exceeds the microwave amplitude threshold signal and the PIR signal 48 does not detect activity (or does not exceed the PIR threshold signal); or if the ratio of the microwave channel detect to the PIR channel detect exceeds some pre-set amount such as 16:0; there are two possible causes. The first possibility is that the PIR channel does not work, i.e. the sensor 40 or any of the electronics to process the PIR signal 42 is inoperative or has been tampered by, for example being masked. To eliminate that possibility, the microcontroller 28 can perform one or more of the following tests:

1. The near infrared LEDs 72*a* and 72*b* can be turned on to emit near infrared radiation. In the event an object is placed sufficiently close to the system 10 to mask the system 10, the object would reflect the radiated near infrared radiation back onto the photo transistor 74 causing the masking signal 76 to be generated. If a masking signal 76 is received, then the conclusion is that the system 10 has been "tampered with" by masking. In the event the masking signal 76 is not received, then the conclusion is that there is no masking and other possibilities need to be explored.

2. The resistor 60, positioned near or adjacent to the PIR detector 40, can be turned on. A current flowing through the resistor 60 would cause the resistor 60 to generate infrared radiation, which would be sensed by the PIR detector 40. Since the resistor 60 is positioned adjacent to or near the PIR detector 40, the activation of the resistor 60 would test the PIR detector 40 and the associated electronic circuits to process that signal.

If the above tests are successfully completed, the conclusion that may be drawn is that due to changes in the environment (static or dynamic) as discussed hereinafter, the sensitivity of the PIR channel has changed.

As used hereinafter, the term dynamic adjustment means that the threshold signal is temporarily adjusted, i.e. lowered and then returned to the value prior to the event which caused the threshold signal to be lowered. By statically adjusting a threshold, it is meant a change of the threshold signal, up or down, so that the new level of the signal becomes the new threshold signal.

II. Adjustment for Changes in Static Conditions.

With respect to the PIR channel, the ambient temperature can change gradually and this change in the static environment can cause error in the detection by the PIR channel. With the system 10 of the present invention, the ambient temperature can be measured continuously or intermittently, over time, by the thermistor 50. If over time, the temperature of the ambient has changed, the sensitivity of the PIR channel is also changed accordingly. To maintain the same level of sensitivity, the PIR threshold signal stored in the microcontroller 28 is also adjusted over time in proportion to the change in the ambient temperature as measured by the thermistor 50. Thus, for example, in a single 24-hour period, during daylight, the ambient temperature would increase. The presence of an intruder in a protected volume of space, would cause a smaller increase in the radiation detected. Therefore, the PIR threshold signal should decrease to increase the sensitivity of the PIR detector 40. Conversely, during night time when the ambient temperature decreases, as measured by the thermistor 50, the PIR threshold signal should be increased proportionally to maintain the same level of sensitivity for the PIR detector 40.

With respect to the microwave channel, it is well known that the microwave channel operates by detecting motion based upon the shift in the frequency of the reflected microwave radiation due to the doppler effect caused by the motion of an intruder. The reflected microwave signal is amplified and the microwave signal 30 is then digitized by the controller 28. The peak magnitude of the doppler shifted microwave signal 30, as digitized in the microcontroller 28, compared to an adjacent peak magnitude of a doppler shifted microwave signal determines the level of sensitivity of the microwave transceiver 12. In the system 10, four peak magnitude signals are taken and are summed and then averaged. This average peak to peak reading is compared to a previous reading of peak to peak values and a determination is made if the average has increased or has decreased. The microwave threshold signal is then also adjusted accordingly. The change in the magnitude of the microwave signal can be caused by a number of environmental conditions, such as fans and motors that are switched over time. For example, the electronic components used in the microwave transceiver 12 can gradually generate larger (or smaller) magnitude microwave signal and the received microwave signal would then also be larger (or smaller) in magnitude (larger or smaller than signals transmitted previously in time). This average of four peak readings compared to a previous reading can be recorded to note the trend. The microwave threshold signal can then be changed to maintain the same level of sensitivity of detection.

The change in the microwave threshold signal and the PIR threshold signal to reflect changes in the static or environmental conditions causes each of the respective detectors (microwave or PIR) to have the same sensitivity as set during installation, thereby assuring the same level of operability as that of installation.

III. Adjustment for Changes in Dynamic Conditions.

Adjustment to the microwave threshold signal and the PIR threshold signal can also occur dynamically due to sudden environmental changes such as that caused by the detection of an intruder. As previously stated, the dynamic adjustment of the threshold signal means that shortly after the event has occurred, the threshold signal is returned to the static values. One embodiment is to re-adjust the threshold signal back to the static level after a pre-determined period of time.

In the case where the PIR channel suddenly generates a large PIR signal 48 and the microwave channel does not detect a sudden large increase in the microwave signal 30 or the microwave high frequency signal 36, then a likely cause for this increase in detection in magnitude on the PIR channel is an intruder walking "slowly". If an intruder passes through each segmented field of view as detected by the PIR detector 40, each PIR signal 48 would have a large duration. Furthermore, each time an intruder walks into or out of a field of view, a separate PIR signal 48 is generated. Each of the PIR signal 48 is generally in the form of a pulse. If an intruder is walking very "slowly" the microwave transceiver 12 would generate a lower frequency and lower amplitude doppler signal (there being a small change due to a small doppler shift). Thus, the microwave signal 30 and the microwave high frequency signal 36 may or may not trigger their respective threshold signal to generate a detectable signal based upon a comparison to the respective microwave threshold signal and microwave high frequency threshold signal.

However, the microcontroller 28 can measure the width of the pulse of the PIR signal 48 which exceeds the PIR threshold signal, and the value of the peak amplitude which exceeds the PIR threshold signal. If an intruder is walking "slowly", then each of the PIR signals 48 would be relatively "long" in duration and thus the "width" of the pulse of the PIR signal 48 which exceeds the PIR threshold signal would be large. The width of the PIR signal 48 which exceeds the PIR threshold signal times the amplitude of the PIR signal 48 which exceeds the PIR threshold signal is a measure of the energy of the intruder as detected by the PIR detector 40. If the microcontroller 28 detects the "width" of the PIR signal 48 multiplied by the peak amplitude which exceeds the PIR threshold signal, being "high" as compared to some preset conditions, and if the microwave signal 30 and the microwave high frequency signal 36 do not trigger a detectable signal or trigger an appreciable number of detectable pulses, then the microcontroller 28 can dynamically (i.e. quickly) adjust the microwave threshold signal to decrease it thereby increasing the sensitivity of the microwave channel. Once this condition of detection of a plurality of PIR signals 48 from the PIR channel terminates, then the microcontroller 28 can reset the microwave threshold signal back to the state where it was before the dynamic change. Apart from the width of the PIR signal 48, which exceeds the PIR threshold signal, multiplied by the amplitude of the PIR signal 48, to indicate the "energy" of the intruder, other characteristics of the PIR signal 48, such as the rise time, or frequency, may be used.

In another case, if the microwave channel generates a large amplitude microwave signal 30, caused by an intruder "running through" the field of view, there would be a large amplitude microwave signal 30 and a high frequency microwave signal 36 generated. In that event, and in the event PIR channel does not generate a PIR signal 48 of an amplitude sufficient to cause it to exceed the PIR threshold signal, then the microcontroller 28 can dynamically decrease the PIR threshold signal. A condition of an intruder "running through" the volume of space is detected by the microcontroller 28 because the microwave detector generates a large amplitude microwave signal 30, confirmed by a strong high frequency microwave signal 36. Thus, the strength of the doppler shifted energy microwave signal 30 and the high frequency microwave signal 36, can be used by the microcontroller 28 to determine the rate of motion by the intruder through the field of view. Based upon this calculation of the rate of motion of the intruder passing through the field of view, the microcontroller 28 can then adjust the PIR threshold signal accordingly if the rate of the motion is "sufficiently high" as to warrant a dynamic change in the PIR threshold signal. Here again, once the event of detection by the microwave transceiver 12 passes, then the microcontroller 28 can adjust the PIR threshold signal back to the condition prior to it being decreased.

As can be seen from the foregoing, with the detection system 10, both "static" and "dynamic" adjustments to the microwave threshold signal and the PIR threshold signal is performed by the microcontroller 28. The adaptation of the microwave threshold signal and the PIR threshold signal can be based upon a simple look-up table or can be based upon a predetermined mathematical relationship.

IV. Detection of an Intruder to Distinguish Between Human Intruder and Animal Intruder.

As can be seen from the foregoing discussion, the microcontroller 28 receives three signals: PIR signal 48, microwave signal 30 and high frequency microwave signal 36. It has been determined that the combination of these three signals processed in a particular manner, can be used to distinguish an intruder between a human intruder and an animal intruder, such as a pet.

Figure 4:
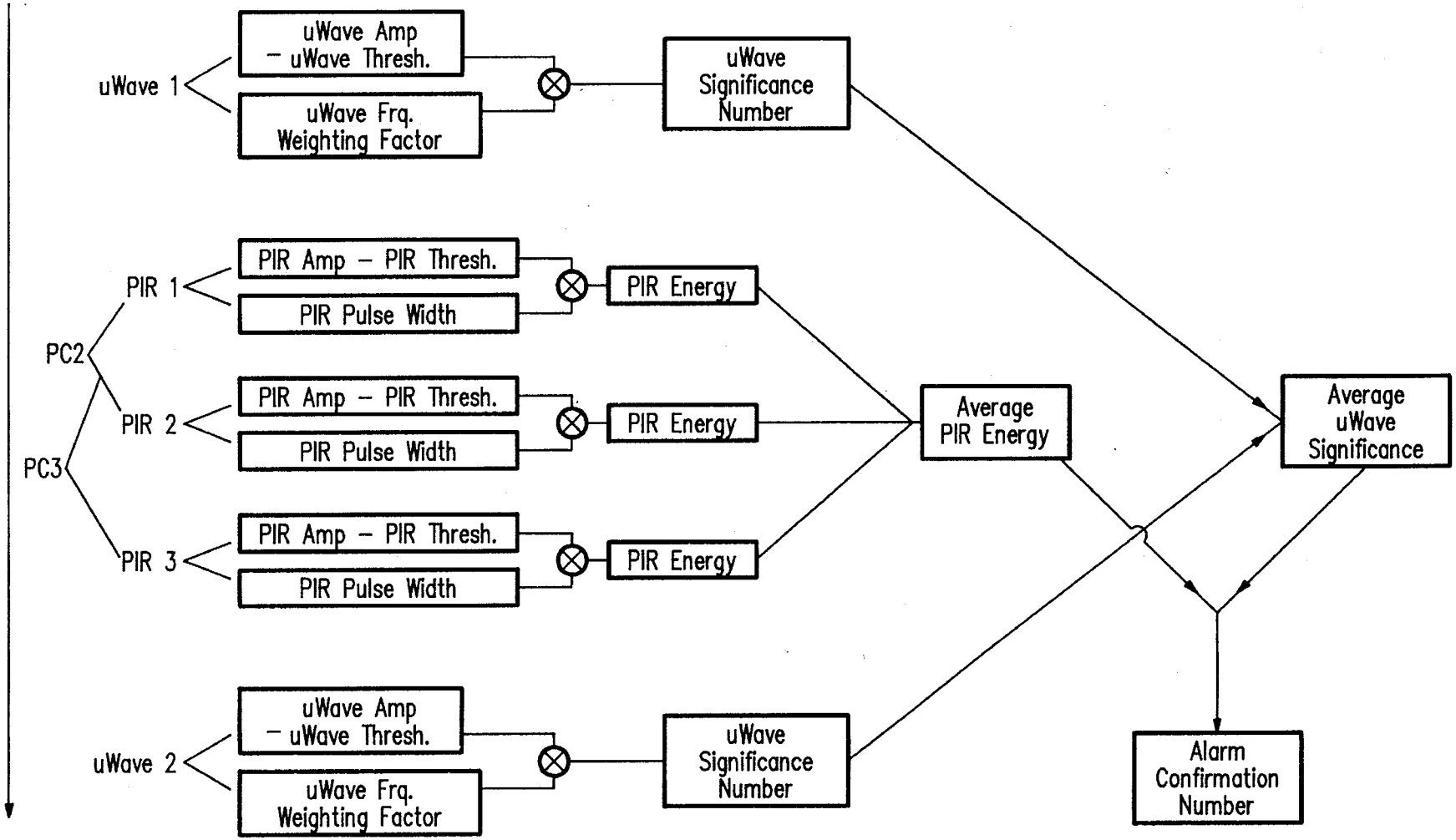
FIG. 4 is a flow chart diagram of an embodiment of another signal processing method used in the apparatus of the present invention shown in FIG. 1.

Referring to FIG. 4, there is shown a flow chart of a timing diagram used to establish whether or not an intruder has been detected in a volume of space. Once an intruder has been detected, by the flow chart as shown in FIG. 4, subsequent processing of the signals would distinguish between the intruder as a human intruder and an animal intruder and thereby generating an alarm signal or not.

To process the amplitude of the microwave signal 30, either a PIR signal 48 or a high frequency microwave signal 36 must be initially detected to initiate the sequence of microwave signal processing. The theory is that for animals or pets there is a less likelihood for them to generate either a detectable PIR signal 48 or a high frequency microwave signal 36 produced in the S band. For purposes of discussion, FIG. 4 shows a flow chart in which a microwave signal 30 is initially detected and starts the sequence. Once the microwave signal 30 is generated, the microcontroller 28 measures the magnitude from a peak of the microwave signal 30 to an immediate adjacent peak which is of opposite polarity. The difference between the two peaks is compared to the microwave threshold signal, shown in FIG. 6. Thus, if the first peak has a magnitude of –UA1, and the magnitude of an immediate adjacent peak of opposite polarity had a magnitude of +UA2, then the difference between UA1 and UA2 is taken. This is then compared to the microwave threshold signal which is stored in the microcontroller 28. If the difference is less than the microwave threshold, then this event is ignored and the last recorded peak is retained for the next reference. If it is greater than the microwave threshold (initially set at 0.4 volts) it is added to a running summation. After four such accumulations of peak to peak magnitude differences, the number is averaged by summing all the peak to peak magnitude and dividing by the total number of peak to peak measurements. The result is compared to a threshold number (nominally initially set at 1 volt). The microwave threshold signal as previously discussed, can be adjusted downward by 115 millivolts based on the duration i.e. pulse width of the PIR signal 48 (if the duration is greater than 1.2 seconds).

If the average microwave peak to peak measurement exceeds the microwave threshold, the threshold is subtracted from it and the result is a microwave amplitude value, which is stored.

At the same time that the microwave amplitude value is generated, the microcontroller 28 looks to see if a microwave high frequency signal 36 is generated. In the processing of the microwave high frequency signal 36, the signal is digitized and is compared to a microwave high frequency threshold which is set initially at 1 second. In the processing of the high frequency microwave signal channel, it is time that is the threshold. The microwave high frequency signal has a number of rising edges and each edge must occur within one second of the previous edge or else the microcontroller 28 resets its counter. The time between each rising edge is summed and after the fifth rising edge is counted, the time is divided by four to obtain an average. This calculation gives a rough calculation of the speed of the intruder. Depending upon the speed of the intruder so calculated, a weighting factor for the microwave high frequency channel is assigned, in accordance as follows:

| Frequency | High Frequency Weighting Factor |
|---|---|
| >19 Hz | 4 |
| 5–10 Hz | 3 |
| <5 Hz | 2 |
| not recorded | 1 |

After the microwave amplitude value and the high frequency weighting factor are calculated, the microwave high frequency weighting factor is multiplied by the microwave amplitude value to derive a first microwave event number.

Figure 6:
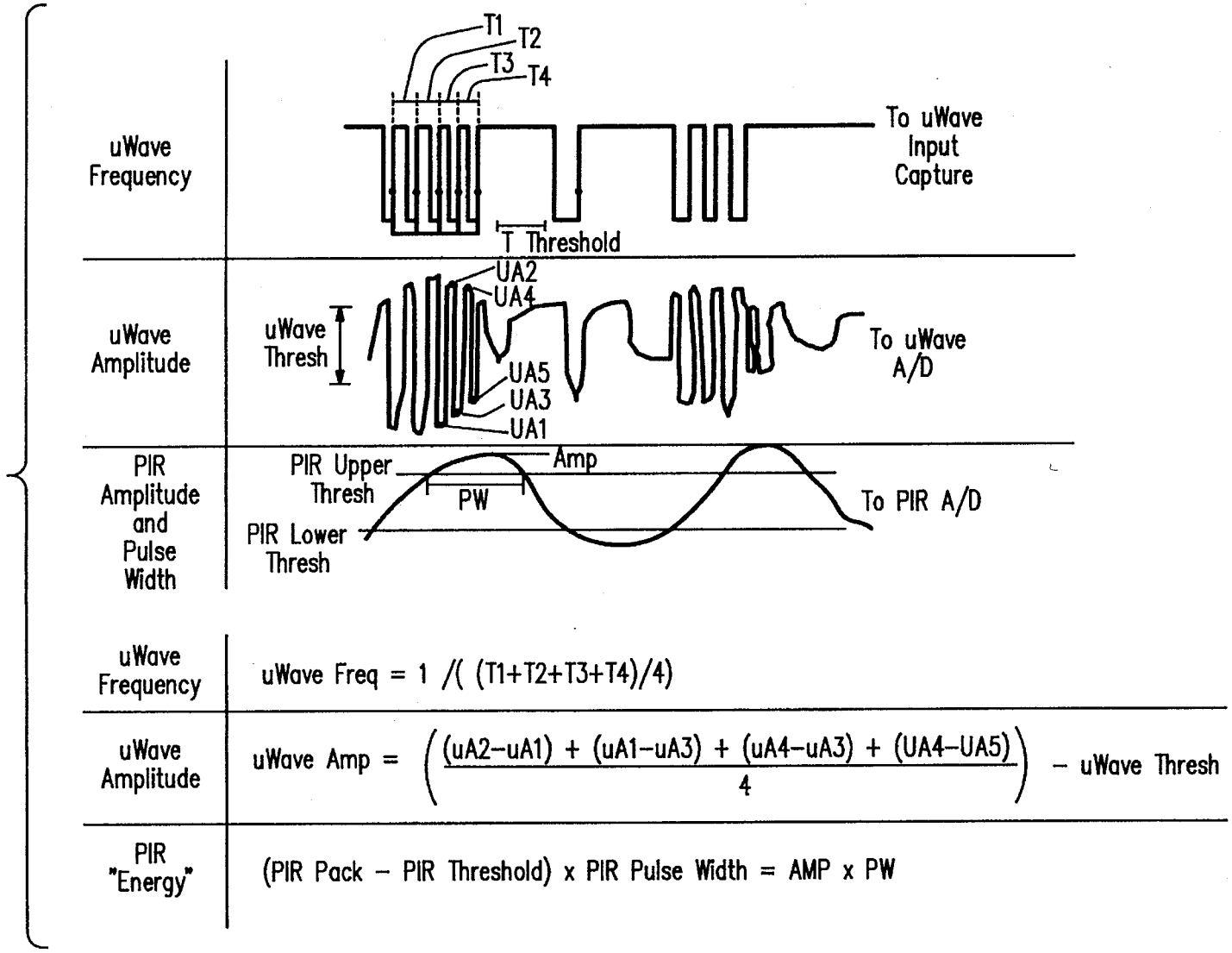
FIG. 6 is a timing diagram of three signals received by the apparatus of the present invention, and how they are processed in the method shown in FIG. 4.

In accordance with the signal processing invention as disclosed in U.S. patent Ser. No. 08/011,647, filed on Jan. 28, 1993, in order for an alarm condition to occur, a PIR signal 48, must be detected within four seconds of the detection of the initial microwave signal 30. As previously discussed, the PIR signal 48 is generally of a pulse shape; although shown greatly exaggerated in FIG. 6, the PIR signal 48 is shown as almost sinusoidal. The PIR signal 48 is digitized and its amplitude is compared to a PIR threshold signal. If the PIR signal 48 exceeds the PIR threshold signal, the amount in time by which the PIR signal 48 exceeds the PIR threshold signal is measured. This is shown in FIG. 6 and is labelled as "PW" for pulse width. Whenever the PIR signal 48 crosses either the positive or negative threshold of the PIR threshold signal, a timer within the microcontroller 28 is started. The microcontroller then continues to look for peak (positive or negative) measured past the threshold point and records this value. After the PIR signal 48 has returned to an amplitude limit within the threshold limit, the clock is stopped. If the time in which the PIR signal 48 exceeds the threshold is less than 260 milliseconds, the PIR event is ignored. If it is greater, it is processed. It should be noted that this threshold of 260 milliseconds is subject to change depending upon operating conditions.

The calculation of the energy for the PIR signal 48 is done by subtracting the PIR threshold signal from the PIR peak amplitude signal and multiplying the result by PIR pulse width as measured. This PIR event value is then stored in memory of the microcontroller 28. If a plurality of PIR signals 48 are generated before a subsequent microwave signal 30 is generated, then each of the PIR signal 48 initiated PIR event causes a calculation of the PIR event value. All of the PIR event values are summed and the result is then averaged.

Finally, to initiate an alarm, a second microwave signal 30 must then be detected within four seconds of the last PIR initiated event. The calculation of the second microwave event value is performed in the same manner as the first microwave event value is calculated.

The first microwave event value and the second microwave event value are then summed and the average is then taken for an average microwave event value. The average microwave event value and the average PIR event value are then added and averaged to determine an alarm confirmation number. The alarm confirmation number is then compared to an alarm threshold number. In the event the alarm confirmation number exceeds the alarm threshold number, then the alarm signal 90 is generated by the microcontroller 28 indicating the presence of a human intruder. If the alarm confirmation number generated is below the alarm threshold number, then no alarm signal 90 is generated and the intruder is deemed to be an "animal" intruder or a pet.

In general, the theory of distinguishing an intruder between a human intruder and an animal intruder is based upon the generalized notion that a human intruder generates more PIR energy, and is more massive and generates a larger doppler shifted high frequency microwave amplitude signal. While a pet or an animal intruder may generate a doppler shifted signal, the magnitude and frequency of that signal would be lower than a human and the PIR energy content would also be lowered. The combination of speed, mass and energy content would result in a human intruder having higher alarm confirmation number than a pet or an animal intruder. Clearly the foregoing described invention can also be used to distinguish between a human intruder, to generate an alarm signal and a false alarm condition, not rising to the level of an alarm condition, which might be caused by a pet or other environmental disturbances.

All of the foregoing described threshold signals, and values, such as, microwave threshold signal of 115 millivolts, PIR pulse width of 1.2 seconds, high frequency threshold of 1 second, high frequency weighting factors, and the PIR threshold of 260 milliseconds may be changed.

What is claimed is:

1. A dual sensing intrusion detection device for detecting an intruder in a volume of space and for distinguishing said intruder between a human intruder and an animal intruder, said device comprising:

microwave sensing means for generating a first signal in response to the detection of the intruder in said volume of space;

first amplifying means for amplifying said first signal and for generating a first amplified signal in response thereto;

high frequency filter means for receiving said first signal and for generating a second signal in response thereto, said second signal being a high frequency portion of said first signal;

second amplifying means for amplifying said second signal and for generating a second amplified signal in response thereto;

PIR sensing means for generating a third signal in response to the detection of the intruder in said volume of space;

third amplifying means for amplifying said third signal and for generating a third amplified signal in response thereto;

digitizing means for digitizing said first, second and third amplified signals to produce first, second and third digitized signals, respectively, wherein said first digitized signal has an amplitude; and processing means for receiving and processing said first digitized signal by measuring the magnitude of said amplitude and comparing said measured amplitude to a first threshold signal, and for generating a first value signal in the event said measured amplitude exceeds said first threshold signal, and for receiving and processing said second digitized signal by measuring the frequency content thereof and for generating a first weighting factor in response thereto, and for receiving and processing said third digitized signal by measuring the energy content thereof;

said processing means further for combining said first value signal with said first weighting factor to generate a first microwave event signal; and for generating a first PIR event signal in response to the energy content measured; and for combining said first microwave event signal with said first PIR event signal to generate an event signal; and for comparing said event signal to an event threshold signal; and for generating an alarm signal in event said event signal exceeds said event threshold signal, wherein said event threshold signal distinguishes between the human intruder and the animal intruder.

2. The device of claim 1 wherein said microwave sensing means is responsive to microwave radiation in the S-band.

3. The device of claim 1 wherein said first digitized signal has a plurality of adjacent peaks, and wherein said processing means measures the magnitude of the difference between a first pair of adjacent peaks as the measured amplitude of said first digitized signal.

4. The device of claim 3 wherein said second digitized signal has a plurality of rising edges and wherein said processing means measures the number of rising edges per unit time and generates said first weighting factor in response to the number of rising edges per unit time measured.

5. The device of claim 4 wherein said third digitized signal has one or more pulses, with each pulse having a width and an amplitude and wherein said processing means measures the width and amplitude of each pulse.

6. The device of claim 5 wherein said processing means combines the width of each pulse with its amplitude, which exceeds a third threshold signal, to generate said first PIR event signal.

7. The device of claim 6 wherein said processing means further measures the magnitude of the difference between a second pair of adjacent peaks as a second measured amplitude of said first digitized signal.

8. The device of claim 7 wherein said processing means combines said second measured amplitude with a second weighting factor responsive to the number of rising edges per unit time measured to generate a second microwave event signal.

9. The device of claim 8 wherein said processing means combines said first and second microwave event signals with the first PIR event signal to generate said event signal.

10. A method of detecting an intruder in a volume of space and for distinguishing said intruder detected from a false intrusion, the method comprising:

generating microwave radiation directed at said volume of space;

receiving reflected doppler shifted microwave radiation from the intruder in said volume of space and generating a first signal in response thereto, said first signal having a frequency range;

filtering said first signal to generate a second signal, which is a portion of the frequency range of said first signal;

generating a third signal, in response to the detection of infrared radiation from the intruder in said volume of space;

amplifying said first, second and third signals to produce first, second and third amplified signals, respectively;

digitizing said first, second and third amplified signals to produce first, second and third digitized signals, respectively, wherein said first digitized signal has an amplitude;

processing said first digitized signal by measuring the magnitude of said amplitude and comparing said measured amplitude to a first threshold signal, and for generating a first value signal in the event said measured amplitude exceeds said first threshold signal;

processing said second digitized signal by measuring the frequency content thereof and generating a first weighting factor in response thereto;

processing said third digitized signal by measuring the energy content thereof;

combining said first value signal with said first weighting factor to generate a first microwave event signal;

generating a first PIR event signal in response to the energy content of said third digitized signal measured;

combining said first microwave event signal with said first PIR event signal to produce an event signal;

comparing said event signal to an event threshold signal;

generating an alarm signal in the event said event signal exceeds said event threshold signal;

wherein said event threshold signal distinguishes between the human intruder and the false intrusion.

11. The method of claim 10 wherein said first digitized signal has a plurality of adjacent peaks, and wherein said step of measuring the magnitude of said amplitude is by:

measuring the magnitude of the difference from a first peak to an immediate adjacent peak of said first digitized signal.

12. The method of claim 11 wherein said second digitized signal has a plurality of rising edges and wherein said step of processing said second digitized signal by measuring the frequency content thereof is by:

counting the number of rising edges per unit time of said second digitized signal.

13. The method of claim 12 wherein said third digitized signal has one or more pulses, with each pulse having a width and an amplitude and wherein said step of processing said third digitized signal by measuring the energy content thereof is by:

measuring the width and amplitude of each pulse of said third digitized signal and combining the width of each pulse with its amplitude which exceeds a third threshold signal.

14. The method of claim 13 further comprising the step of:

measuring the magnitude of the difference between a second peak to an immediate adjacent peaks as a second measured amplitude of said first digitized signal.

15. The method of claim 14 further comprising the step of:

combining said second measured amplitude with a second weighting factor responsive to the number of rising edges per unit time measured to generate a second microwave event.

16. The method of claim 15 further comprising the step of:

combining said first and second microwave events with the first PIR event to generate said event signal.

17. A method of detecting an intruder in a volume of space and for distinguishing said intruder detected from a false intrusion, the method comprising:

generating microwave radiation directed at said volume of space;

receiving reflected doppler shifted microwave radiation from the intruder in said volume of space and generating a first signal in response thereto;

amplifying said first signal to produce a first amplified signal;

digitizing said first amplified signal to produce a first digitized signals wherein said first digitized signal has a plurality of peaks;

measuring the magnitude of the difference from a first peak to an immediate adjacent peak of said first digitized signal;

comparing said magnitude measured to a first threshold signal, and generating a first value signal in the event said magnitude measured exceeds said first threshold signal;

determining the frequency content of said first digitized signal and generating a first weighting factor in response thereto;

modifying said first value signal by said first weighting factor, to generate a microwave event signal;

averaging a plurality of said microwave event signals to generate an average microwave event signal;

generating a second signal, in response to the detection of infrared radiation from the intruder in said volume of space;

amplifying said second signal to produce a second amplified-signal;

digitizing said second amplified signal to produce a second digitized signal;

measuring the energy content of said second digitized signal;

generating a PIR event signal in response to the energy content of said second digitized signal measured;

averaging a plurality of said PIR events signals to generate an average PIR event signal;

combining said average microwave event signal with said average PIR event signal to produce an event signal;

comparing said event signal to an event threshold signal;

generating an alarm signal in the event said event signal exceeds said event threshold signal;

wherein said event threshold signal distinguishes between the human intruder and the false intrusion.

18. The method of claim 17 further comprising the step of:

filtering said first signal to generate a third signal;

digitizing said third signal to produce a third digitized signal, wherein said third digitized signal has a plurality of rising edges;

counting the number of rising edges per unit time of said third digitized signal as said step of determining the frequency content of said first digitized signal.

19. The method of claim 18 wherein said second digitized signal has one or more pulses, with each pulse having a width and an amplitude and wherein said step of measuring the energy content of said second digitized signal is by:

measuring the width and amplitude of each pulse of said second digitized signal and combining the width of each pulse with its amplitude which exceeds a third threshold signal.

* * * * *